US005324062A

United States Patent [19]

Rigal et al.

[11] Patent Number: 5,324,062

[45] Date of Patent: Jun. 28, 1994

[54] SAFETY BINDING FOR ALPINE SKIS

[75] Inventors: Jean-Pierre Rigal, La Balme de Sillingy; Philippe Lemoine, Meythet; Pierre Desarmaux, Evires; Philippe Schary, Meythet, all of France

[73] Assignee: Salomon S.A., Chavanod, France

[21] Appl. No.: 853,709

[22] PCT Filed: Dec. 13, 1990

[86] PCT No.: PCT/FR90/00908

§ 371 Date: Jun. 5, 1992

§ 102(e) Date: Jun. 5, 1992

[87] PCT Pub. No.: WO91/08806

PCT Pub. Date: Jun. 27, 1991

[30] Foreign Application Priority Data

Dec. 15, 1989 [FR] France ..... 89 16653
Nov. 29, 1990 [FR] France ..... 90 15183

[51] Int. Cl.[5] ..... A63C 7/10
[52] U.S. Cl. ..... 280/605; 280/607
[58] Field of Search ..... 280/607, 604, 605, 617, 280/618, 633, 634, 636, 615

[56] References Cited

U.S. PATENT DOCUMENTS 4,239,256 12/1980 Krob et al. ..... 280/605
5,118,128 6/1992 Piegay et al. ..... 280/633
5,158,317 10/1992 Sedlmair et al. ..... 280/605

*Primary Examiner*—Richard M. Camby
*Attorney, Agent, or Firm*—Pollock, Vande Sande & Priddy

[57] ABSTRACT

Alpine ski binding designed to hold the rear end of a boot in place on a ski. The binding comprises a body (3) connected to the ski, a device (2) for position-retention of the rear end of the boot, which is carried by the body, and a support plate for the boot (9), on which the rear end of the sole rests. The support plate is mobile in the median longitudinal and vertical plane, and a layer (15) of an elastically-compressible material is interposed between the support plate and the upper surface of the ski. In particular, the plate is interposed around an axis (25) carried by the stirrup piece which holds the rear part of the slide-rail (4) in position on the ski.

11 Claims, 9 Drawing Sheets

SAFETY BINDING FOR ALPINE SKIS

FIELD OF THE INVENTION

The invention relates to an alpine ski binding designed to hold the rear end of a boot in place on a ski.

BACKGROUND OF THE INVENTION

Numerous rear bindings of this type are currently known. They generally comprise a slide-rail mounted on the ski, a body which can slide along the slide-rail, and a boot position-retention jaw carried by the body. The bindings also comprise a support plate on which the rear end of the sole of the boot rests.

A brake is normally connected to the rear binding to stop the travel of the ski after the boot has been released. This brake generally comprises mobile brake arms or spade-like elements and a control pedal.

For some conventional bindings, the support plate for the boot is constituted by the brake control pedal.

In currently-known devices and in the presence of the boot, the support plate rests directly against the upper surface of the ski, so that the sole of the boot is supported directly on the ski, i.e., with no shock-absorption mechanism.

Accordingly, the shocks and vibrations to which the ski is subjected are transmitted to the boot and are felt by the skier.

To improve the skier's comfort, conventional practice includes, as described in particular in French Patent No. 2 602 979, a binding mounted on a ski by means of a plate made of a viscoelastic material, so that no rigid means, such as a screw, attaches the ski to the slide-rail.

As regards comfort, this binding gives good results. In fact, the layer of viscoelastic material absorbs the shocks and vibrations to which the ski is subjected.

On the other hand, this binding causes impairment of the accuracy with which the ski is steered. In fact, to steer the ski, the skier performs lateral maneuvers or driving movements with his boots, and these movements are transmitted to the edges of each of the skis. These maneuvers and driving movements are also filtered out by the layer of viscoelastic material.

SUMMARY OF THE INVENTION

One of the objects of the present invention is to propose a binding which remedies this disadvantage and which provides both comfort and a high level of steering precision.

Another object of the invention is to propose a binding whose construction is simple and inexpensive.

Other objects and advantages of the invention will emerge from the following description.

The alpine ski binding according to the invention is designed to hold the rear end of ski boot in position. Comprises a body attached to the ski, a device holding the rear end of the boot in position and carried by the body, and a plate supporting the boot, on which the rear end of the sole rests in the normal position in which the boot is held in place in the binding.

The boot-support plate is mobile in the median vertical, longitudinal plane of the ski, and a layer of an elastically-compressible material is interposed between the support plate and the upper surface of the ski.

According to a first embodiment of the invention, the body of the binding is mounted so as to slide along a slide-rail. The support plate is extended rearward by two arms, each of which is jointed to the stirrup piece which holds the rear part of the slide-rail against the ski.

According to a variant, the arms extending the support plate rearward are jointed around a horizontal, transverse axis carried by the slide-rail.

According to another variant, the support plate is jointed around a horizontal, transverse axis carried by the body of the binding.

According to a variant application of the invention, the ski binding is equipped with a brake, and the support plate constitutes, the base of the brake to which the brake arm and control pedal in particular are jointed.

According to another embodiment of the invention, the support plate comprises two elements arranged on either side of the median vertical, longitudinal plane of the ski. The two elements are jointed rotationally around a common horizontal, transverse axis. Coupling means, such as a pin, make it possible to connect the free ends of each of the elements.

According to a further embodiment of the invention, the layer of elastically compressible material is interposed between the control pedal of the brake, which constitutes the support plate of the boot, and the upper surface of the ski.

BRIEF DESCRIPTION OF THE DRAWINGS

The invention will be better understood by referring to the description below and to the attached drawings, in which several embodiments of the invention are shown for purposes of illustration.

DESCRIPTION OF PREFERRED EMBODIMENTS

Figure 1:
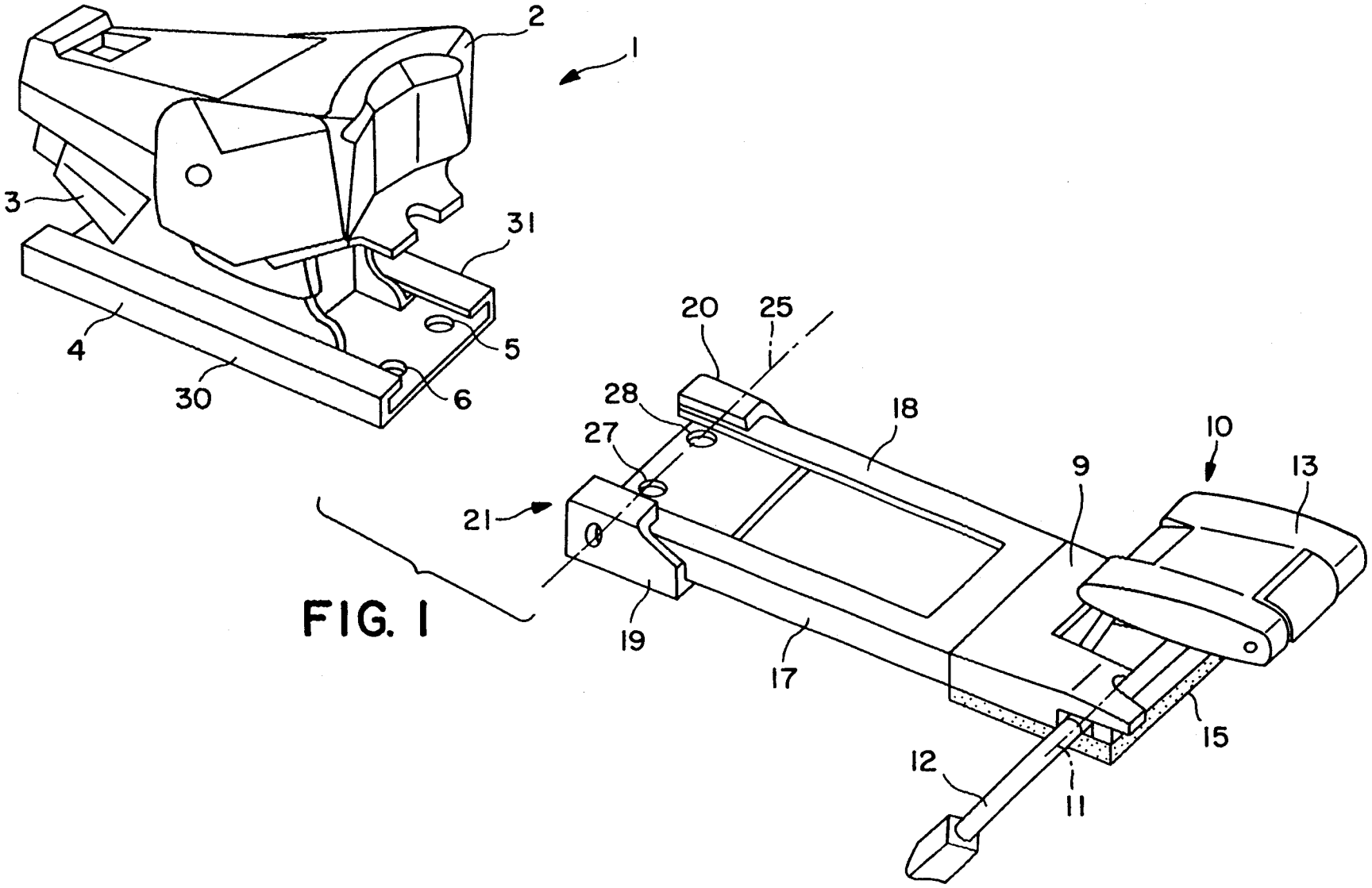
FIG. 1 is a perspective view of a binding according to a first embodiment of the invention.

FIG. 1 shows a binding 1 designed to hold the rear end of a ski boot in place.

The binding 1 comprises a device for holding the boot end in place and is constituted by a jaw 2, which is carried by a body 3.

In a conventional manner, the jaw 2 is returned elastically to a low position in which it holds the boot end in place on the ski. The elastic return means of jaw 2 are housed inside the body 3.

The body 3 is guided for sliding motion along a slide-rail 4. In conventional fashion, the longitudinal position of the body 3 along the slide-rail can be adjusted by means such as a bolt or endless screw. This position is controlled so as to adjust the position of the binding to the length of the boot. From this position, the body 3 can be drawn back, in particular when the ski is bent, against the elastic return force of a return spring.

In the embodiment illustrated in FIG. 1, the slide-rail 4 has, when seen in cross-section, the shape of a C lying on its side, the opening facing upward. The front part of the slide-rail 4 has two holes 5 and 6 for insertion of screws for assembly of the slide-rail to a ski.

The binding 1 further comprises a support plate 9 on which the rear end of the sole of the boot rests during skiing. In the example illustrated, the support plate 9 forms moreover the base of a brake 10. In particular, the support plate carries the hinge pin 11 which joins the arms of the brake 12 and the control pedal 13. The elastic jaw return means cause the jaw 2 to keep the sole of the boot elastically supported on the support plate 9.

According to the invention, the support plate 9 is mobile in the median vertical, longitudinal plane of the ski, and a layer of an elastically-compressible material 15 is interposed between the support plate 9 and the ski. In the example illustrated, the support plate 9 is extended rearward by two arms 17 and 18 are jointed together, respectively, at each of the lateral edges 19 and 20 of a stirrup piece 21, so that the support plate 9 and the arms 17 and 18 can pivot around a horizontal, transverse axis 25 carried by the stirrup piece 21.

The stirrup piece 21 also has the shape of a C lying on its side, the opening turned upward. Its internal dimensions are substantially equal to the external dimensions of the slide-rail 4. In addition, two screw holes 27 and 28 are provided in the lower part for the insertion of assembly screws.

The arms 17 and 18 advantageously have an L-shaped section positioned so as to cover the upper, lateral faces of each of the lateral edges 30 and 31 of the slide-rail 4. Furthermore, the space between the two arms 17 and 18 is sufficient to allow the body 3 to pass between the arms.

The binding 2 is mounted on the ski in the following way. After boring front holes using a drilling jig, the stirrup piece 21 is attached to the ski using screws which pass through the holes 27 and 28. Next, the body 3 and the slide-rail 4 are engaged in the stirrup piece 21 from the rear and are slid until the screws inserted in the holes 5 and 6 are positioned facing their respective front holes. These screws are then tightened.

Figure 2:
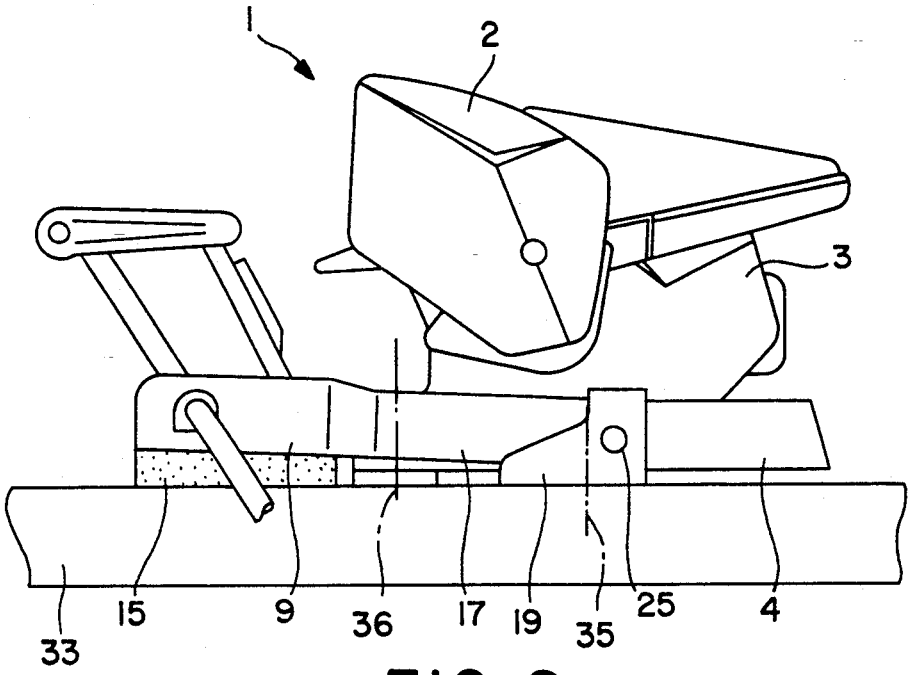
FIG. 2 is a side view of the binding in FIG. 1, mounted on a ski.

FIG. 2 illustrates the binding 1 after it has been mounted on a ski 33, in a position in which it is ready for engagement of the boot.

The positioning of the assembly screws for mounting the stirrup piece 19 and the front part of the slide-rail 4, respectively, is diagrammed in FIG. 2 at 35 and 36.

FIG. 2 shows, more specifically, the layer of elastically-compressible material 15, which is interposed between the support plate 9 and the upper surface of the ski. It can be seen, moreover, that the support plate 9 and the arms 17 and 18 are substantially pivoted upward, because of the presence of the layer 15.

Figure 3:
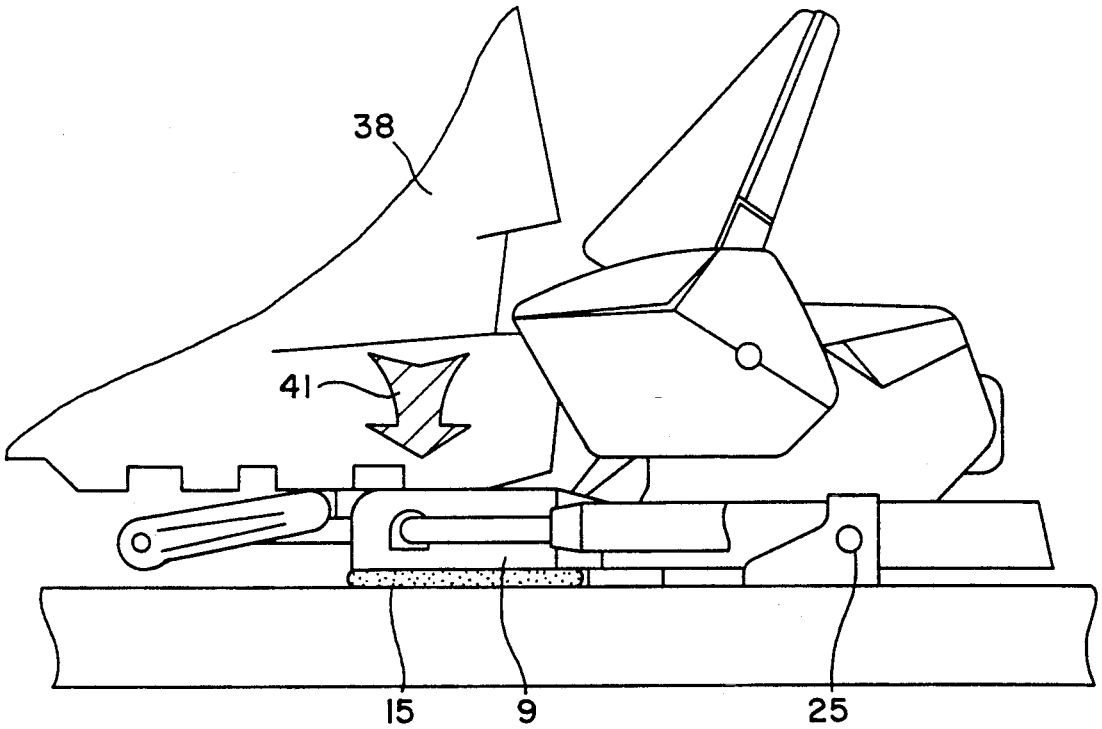
FIG. 3 illustrates the binding in FIG. 2 after engagement of the boot.

FIG. 3 shows the binding in FIG. 2 after engagement of the boot, with its rear part 40. Arrow 41 indicates the vertical downward force which the boot exerts on the support plate 9, and which causes the support plate 9 to swivel around the axis 25 and, in addition, the compression of the layer of elastically-compressible material 15. During skiing, the layer 15 acts as a shock-absorber or as an elastic suspension between the support plate 9 and the ski. It must, nevertheless, be emphasized that the movement of the support plate 9 is limited to travel in a plane parallel to the median vertical, longitudinal plane of the ski. In fact, the articulation 25 connecting the plate 9 to the stirrup piece 21 blocks any other movement of the plate 9, and, in particular, all movement around a horizontal axis parallel to the longitudinal direction of the ski. Thus, the lateral movements of the boot are transmitted directly to the ski, especially to the ski edges, and the precision with which the ski is steered is not perceptibly affected by the presence of the layer 15.

The jaw 2 accompanies the vertical movements of the boot in relation to the ski, as a result of the elastic return means which elastically prevent the boot from the moving away from ski.

The material which composes the layer 15 is of any suitable type. Good results have been obtained using an elastomer material with viscoeleastic properties and a harness of approximately 30 Shore A. The layer may have a rectangular parallelepiped shape and a thickness of about 15 millimeters. In addition, the layer may have recesses in its central part.

The hardness of the layer may, however, be between 10 and 90 Shore A and the thickness may vary between 3 and 7 millimeters and may increase gradually from back to front.

In addition, the layer 15 could be composed of two separate parts, and may be made of any elastically compressible material, with or without dynamic damping capability.

As regards the connection between the binding and the ski, it must be stressed that only the front-part of the slide-rail 4 is attached to the ski, i.e., in the area 36 in which the screws are placed. In the region of the stirrup piece 21, the slide-rail 4 is substantially raised off the ski, and it can slide longitudinally into the stirrup piece. Accordingly, the rear binding stiffens the ski only moderately, and interferes only moderately with ski flection.

Figure 4:
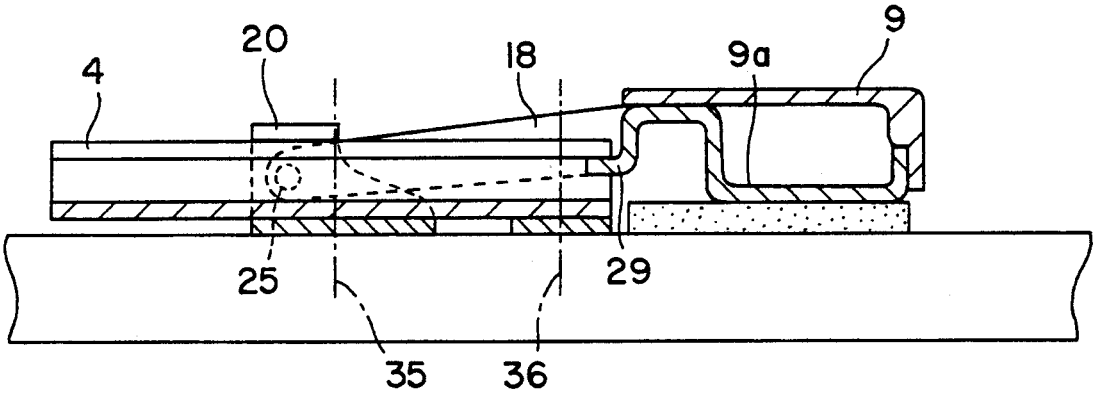
FIG. 4 is a partial longitudinal cross-section view of the binding in FIG. 2.

FIG. 4 is a side cross-section view of the binding 1, in the area of the slide-rail.

According to a preferred embodiment, a stop restricts the upward pivoting of the support plate 9.

FIG. 4 shows this stop as a tongue 29 which extends the base **9*a* of the brake to the rear. This base 9*a* is covered by the support plate 9**.

The tongue 29 is engaged inside the lateral edges 30 and 31 of the slide-rail.

As FIG. 4 shows, the vertical movement of the tongue is limited upward by the interior profile of the lateral edges 30 and 31 of the slide-rail.

Figure 5:
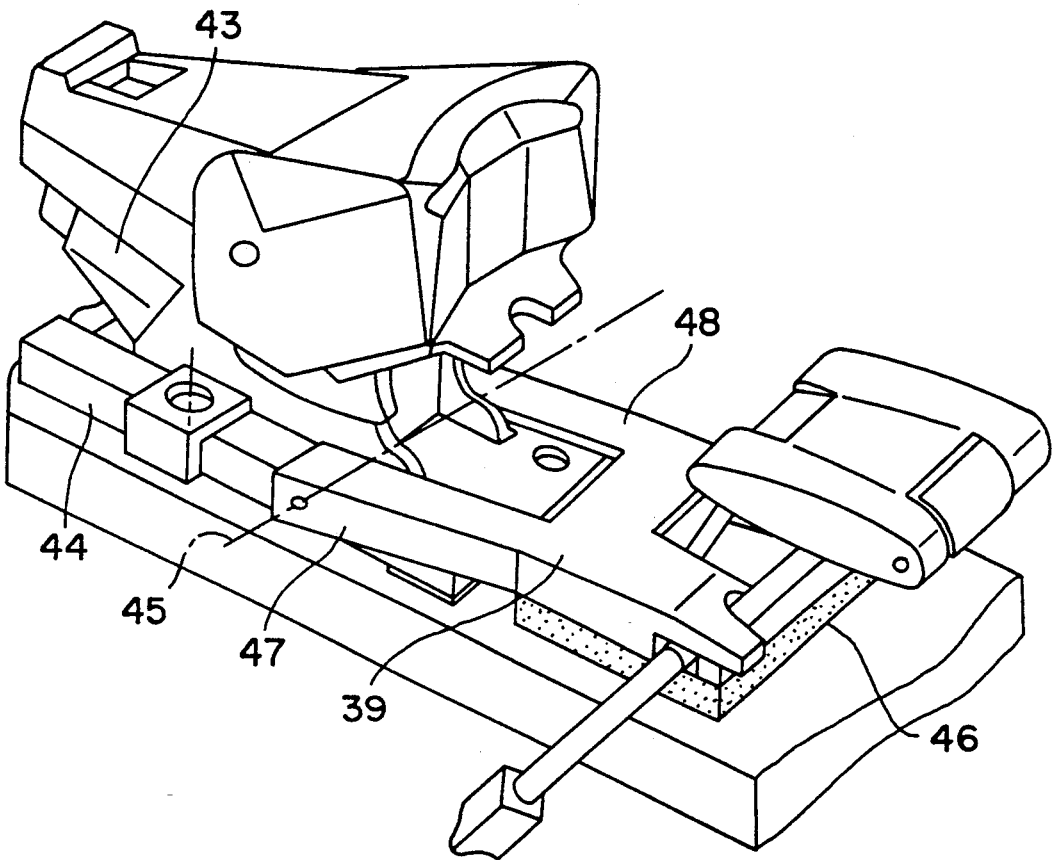
FIG. 5 is a perspective view illustrating another embodiment of the invention.

FIG. 5 illustrates a variant, according to which the support plate 49 is extended rearward by arms 47 and 48. The arms are jointed to the slide-rail 44 itself, at an axis 45. As in the preceding case, a layer of an elastically-compressible material 46 is interposed between the support plate 39 and the ski.

This binding functions in identical fashion to the preceding binding, except that, in the present instance, the arms 47 and 48 are substantially shorter and that they are attached to the slide-rail belonging to the binding.

Figure 6:
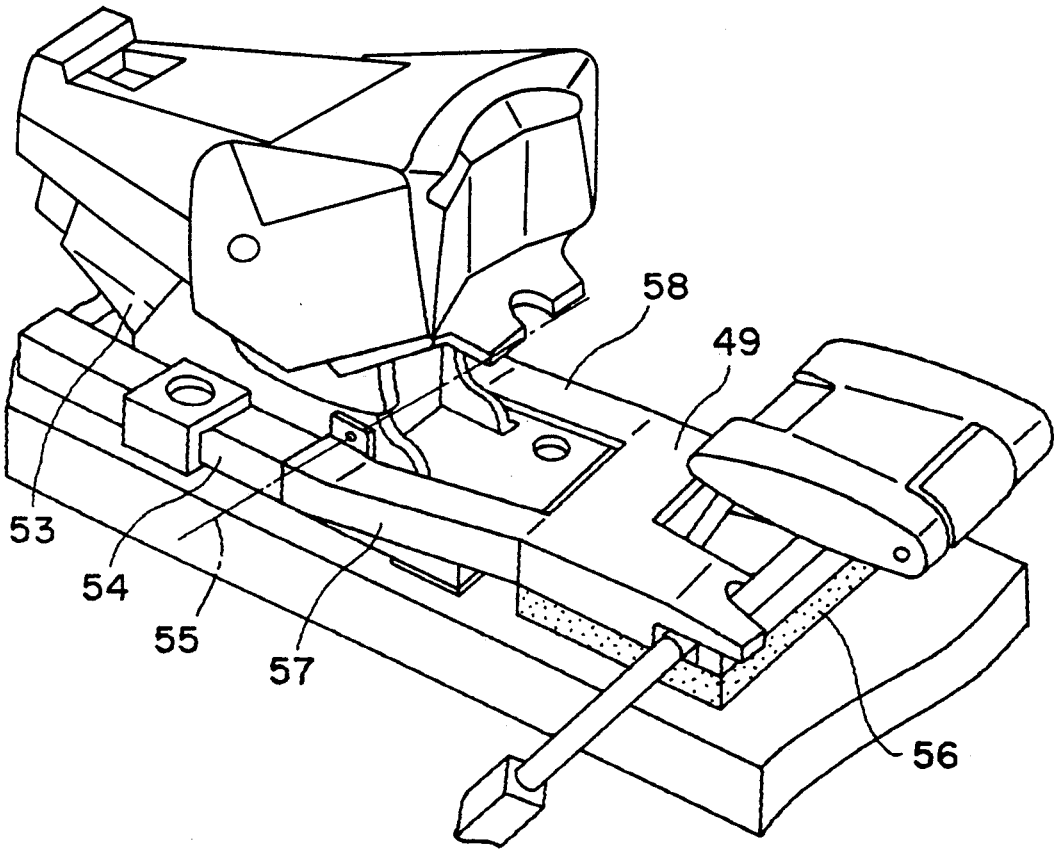
FIG. 6 illustrates another embodiment of the invention.

FIG. 6 shows another variant, in which the hinge pin 55 jointing the arms 57 and 58 is carried by the body 53 of the binding. Thus, the support plate 49 moves with the body 53 during its various longitudinal displacements. As in the preceding case, a layer of an elastically-compressible material 56 is interposed between the support plate 49 and the ski.

Figure 7:
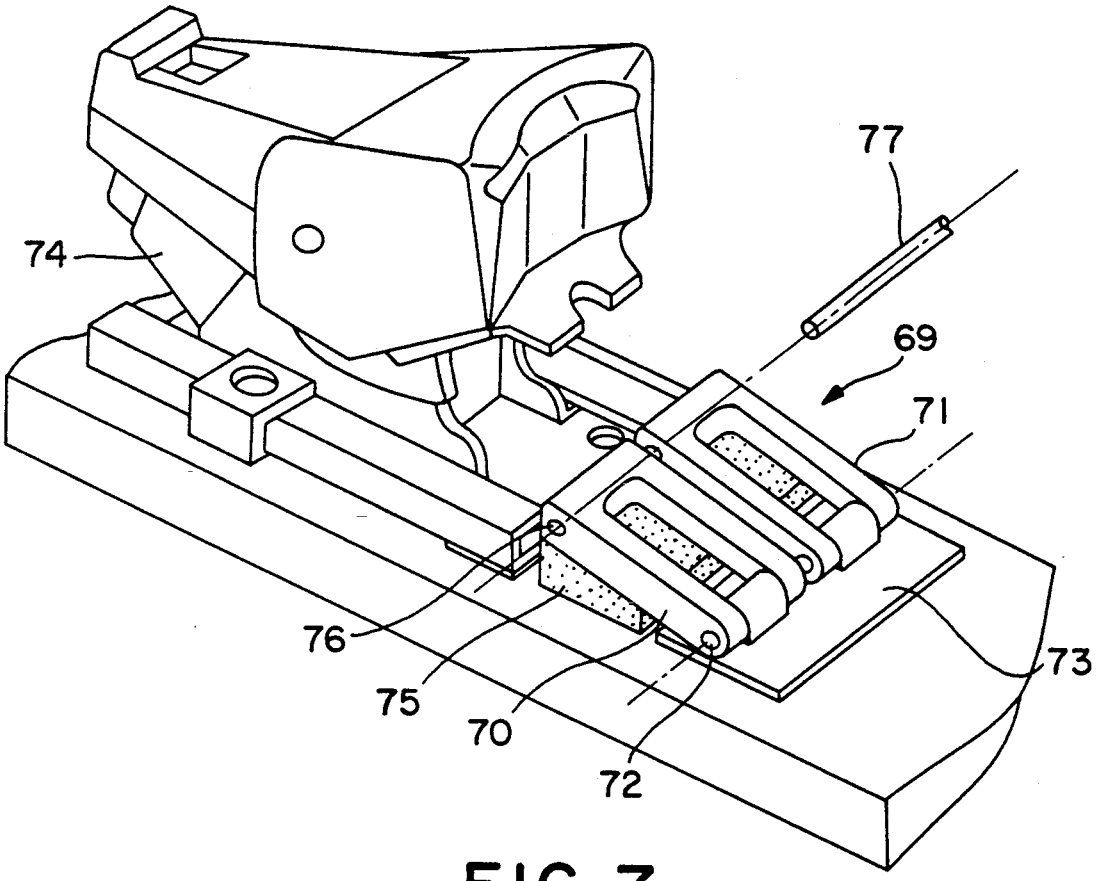
FIG. 7 is a perspective view illustrating another embodiment of the invention.

With reference to FIG. 7, the support plate 69 is constituted by two elements 70 and 71 positioned on either side of the median longitudinal, vertical plane of the ski. The two elements are substantially symmetrical in relation to this plane, and their lower ends are connected by means of a horizontal, transverse hinge pin 72 to a plate 73 mounted on the ski. A layer 75 of an elastically-deformable material is arranged beneath the free ends of the two elements 70 and 71. The sole of the boot rests in the area of these free ends.

Moreover, a hole 76 positioned horizontally and transversely is drilled in the area of the free ends of each of elements 70 and 71. When the two elements 70 and 71 are placed at the same height, the two holes are aligned. Only the hole 76 in the element 70 is visible in FIG. 6. A pin 77 may be inserted in these holes 76 so as to join together the two elements forming the support plate 69. Of course, any other coupling means can be used. However, these coupling means are movable or can be disengaged.

The support plate 69 functions in the following manner. Depending on the quality of the snow, the pin 77 is inserted or not inserted in the hole 76. If the pin 76 is inserted so as to join the two elements 70 and 71, the support plate 69 functions in a manner similar to that previously described, and the layer of elastically deformable material 75 forms a shock-absorber or suspension between the boot and the ski.

If the pin 77 is not inserted, the two elements 70 and 71 work independently of each other, and the layer 75 absorbs not only vertical movements of the boot, but also some of the rolling movements described by the boot in relation to the ski. It is known, in fact, that soft snow allows greater tolerance and flexibility in steering the ski. Accordingly, this rolling motion improves comfort without perceptibly impairing the precision with which the ski is steered.

According to a variant, the block 75 is made in two parts positioned beneath each of the free ends of elements 70 and 71, respectively. These two parts of the block 75-have different hardnesses and are arranged symmetrically on the two skis, so that the two blocks having the lesser hardness are positioned either to the inside or to the outside of the skis. Accordingly, when the pin 77 is not used, absorption of the rolling motion by the boot is different, depending on whether the movement of the boot occurs to the inside or the outside of the ski. On the other hand, when the pin 77 is inserted in the holes 76, the two elements 70 and 71 react in exactly the same way, and the operation of the plate 69 is similar to that of the aforementioned plates 9, 39, and 49.

Figure 8:
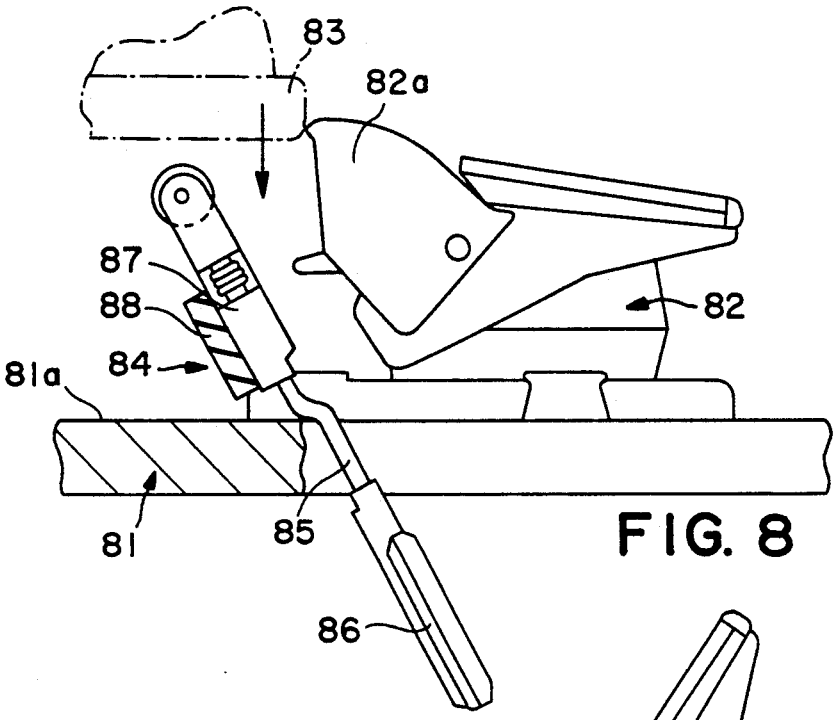
FIG. 8 is a view of another embodiment of the invention as applied to the case in which the plate supporting the boot is constituted by the control pedal of the brake.
Figure 9:
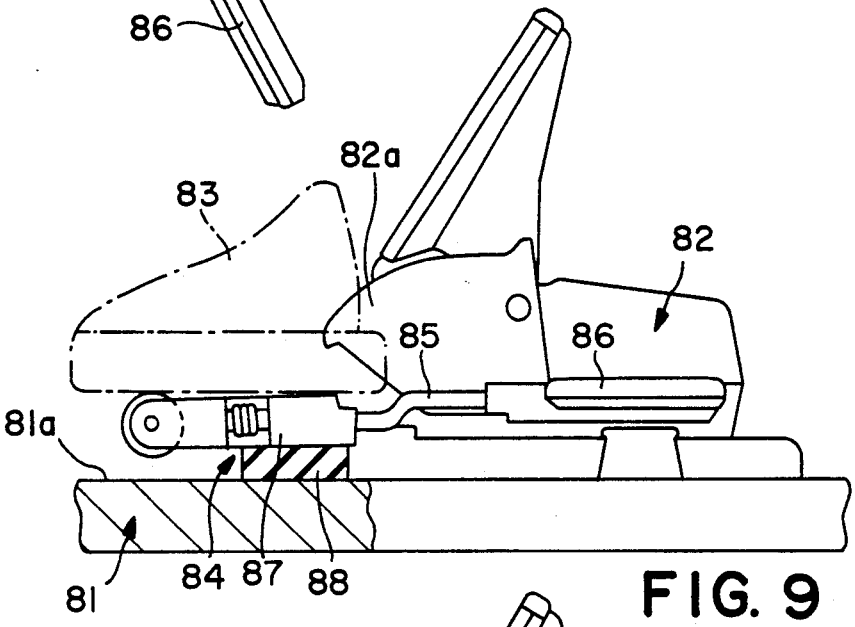
FIG. 9 is a raised view of the brake belonging to the ski FIG. 1 in the inactive position, a boot being locked in place on the ski by means of the heel piece.

FIGS. 8 and 9 show a ski 81 which on which is mounted a heel piece 82 comprising a front mobile jaw **82*a* designed to lock in position the rear end of a boot 83 while skiing. A ski brake 84 is mounted in front of the heel piece 82, this brake comprising mainly two stop arms 85 arranged on either side of the ski which are mounted so as to pivot around a transverse axis and which carry at their lower ends spade-like elements 86 designed to implant in the snow. The ski brake further comprises an energy-generating device of any suitable type (not shown), which ensures that the ski brake 84 is returned to its functional braking position (shown in FIG. 8) when the boot 83 is not pressing on the ski. The upper part of the ski brake 84 incorporates, in addition, a control pedal 87 on which the sole of the boot 83 rests when it is put on, in order to cause the stop arms 85 to pivot around their transverse axis and to bring the ski brake to its inactive position (illustrated in FIG. 9**).

The control pedal 87 here constitutes the support plate for the boot.

A ski brake of this kind is described, for example, in French Patent Application No. 2 526 321.

In this brake, the control pedal 87 and the brake arms 85 rotate around an imaginary horizontal axis which is perpendicular to the longitudinal axis of the ski. This axis is given approximately physical form by the two ends of the spring loop shaped like a Ω, which provides for the elastic return of the brake.

Figure 10:
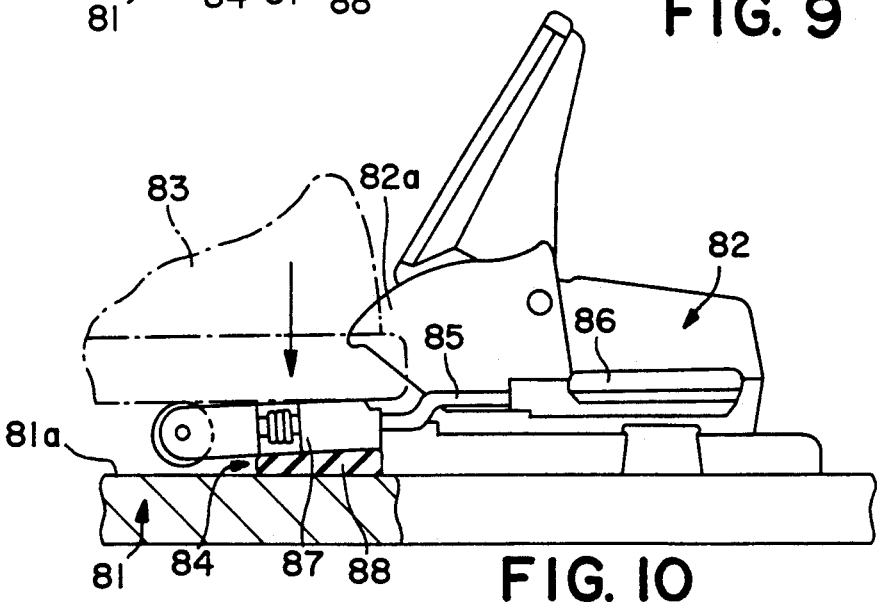
FIG. 10 is a raised view of the ski brake, the brake pedal being drawn downward by the boot while skiing.

When describing a movement of rotation, the control pedal 87 is thus guided in the median longitudinal and vertical plane, i.e., the plane illustrated in particular in FIGS. 8 to 10. The hinge pin associated with the pedal prevents, moreover, any movement of the pedal other than its movement of rotation in this plane.

According to the invention, a shock-absorption element is interposed between the control pedal 87 of the ski brake and the upper surface **81*a* of the ski 81**.

In the embodiment illustrated in FIGS. 8 to 10, the shock-absorption element 88 is constituted by a layer of an elastically-compressible material with only elastic properties, defined by a degree of hardness, or both elastic and shock-absorption properties, defined by a coefficient of shock absorption. The shock-absorption element 88 is attached beneath the pedal 87 using appropriate means, e.g., by adhesive bonding. It may extend over the entire lower surface of the pedal 87, or only a portion of this surface. According to a variant, the shock-absorption element 88 may be made of several parts forming what may be called individual elastic pins attached beneath the pedal 87 and spaced apart. The shock-absorption element 88 may also have recesses.

When the boot is put on and during skiing, the pedal 87 may oscillate appreciably around its position of equilibrium as a result of the compression of the shock-absorption element 88, which is crushed between the pedal 87 and the upper surface **81*a* of the ski, as shown more clearly in FIG. 9 and 10. The heel of the boot then rests on the pedal 87, which is pressed on the elastic support base formed by the shock-absorption element 88 interposed between the pedal 87 and the upper surface 81*a* of the ski 81, and it is brought back, elastically also, by the jaw 82*a* on the heel piece. This jaw 82*a* can swivel elastically over beyond this range, the heel piece releases and the jaw 82*a* releases the boot 82. Consequently, within this range of elastic travel of the jaw 82*a*, the heel of the boot 83 rests on the control pedal 87 of the ski brake, producing a damping effect, and the jaw 82*a*** follows precisely the swinging movements of the sole.

During these swinging movements, the pedal 87 of the brake pivots around the transverse axis of the brake arms 85. It is thus guided in relation to this axis and itself guides the boot in an up-an-down movement in a vertical plane, with no transverse rolling motion in relation to the ski. An effective connection between the boot and the ski is thus preserved with respect to the driving and transverse movements which the skier's leg transmits to the ski, especially during turns and when the edges are dug into the snow.

Figure 11:
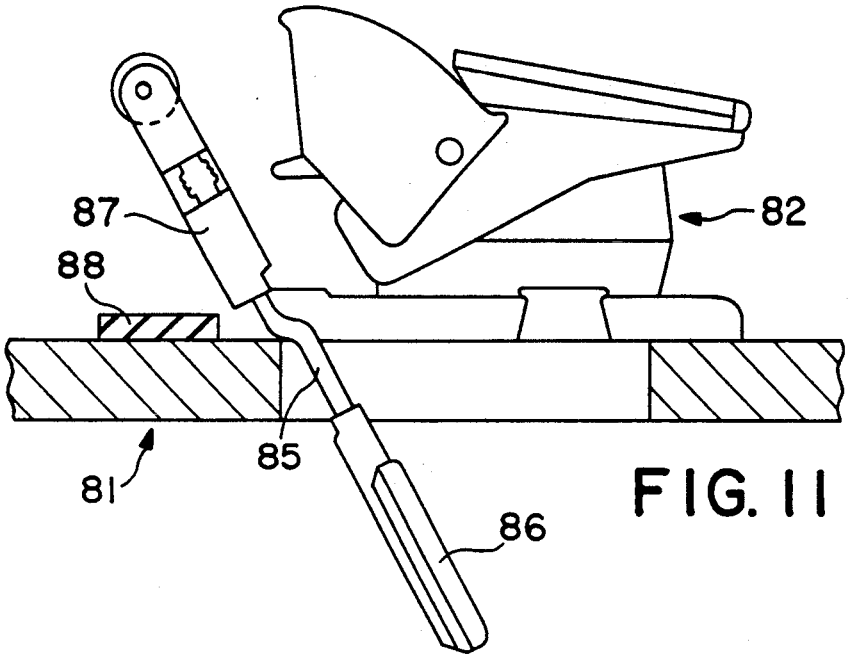
FIG. 11 is a raised view of a variant of the ski brake in braking position.

In the variant shown in FIG. 11, the shock-absorption element 88 is bonded to the upper surface 81*a* of the ski, in the area in which the pedal 87 depresses when it is moved to its inactive position.

Figure 12:
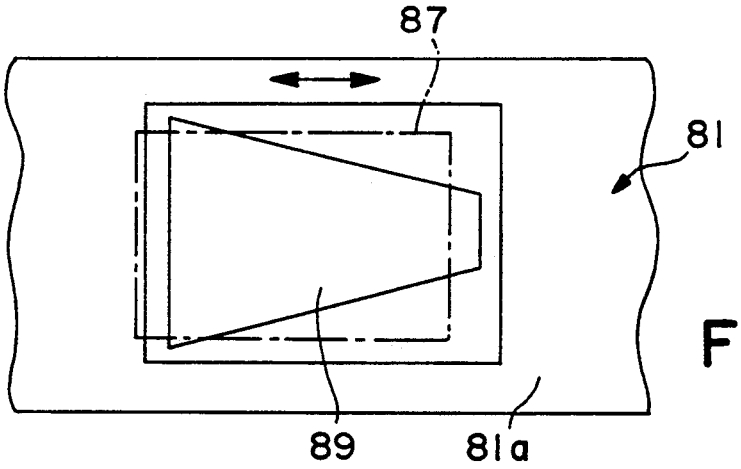
FIG. 12 is a plan view of a variant of the damping element of the ski brake.

In the variant shown in FIG. 12, the shock-absorption element 89 is constituted by a block of a flexible, elastic material whose thickness is uniform but whose width is variable longitudinally, this block 89 having in plan view, the shape of an isosceles triangle, for example. This trapezoidal block 89 is attached in an adjustable longitudinal position, as indicated by the arrow in FIG. 12, in the area in which the pedal of the brake 87 is depressed, as shown in dot-and-dash lines. Consequently, by modifying the longitudinal position of the shock-absorption block 89 it is possible to vary to elastic response.

Figure 13:
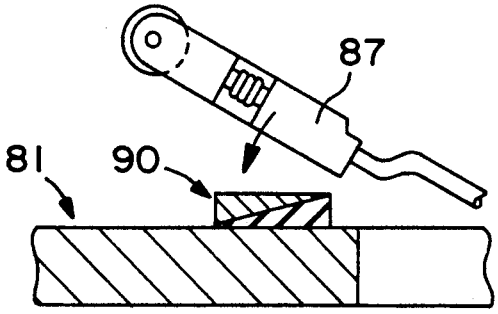
FIGS. 13 and 14 are vertical cross-section views of another variant of the damping element of the ski brake.
Figure 14:
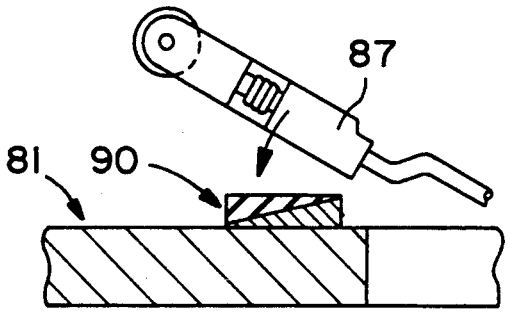

In the variant shown in FIGS. 13 and 14, the shock-absorption element 90 is of uniform thickness and is constituted by the superposition of two layers of material having different elasticity properties and thicknesses which vary longitudinally in opposite directions. As a result, shock-absorption element 90 has a stiffness which varies progressively as it extends longitudinally. Accordingly, by attaching the shock-absorption element 90 to the upper surface 81 of the ski by one or the other of its principal faces, it is possible to obtain different elastic responses from it.

Figure 15:
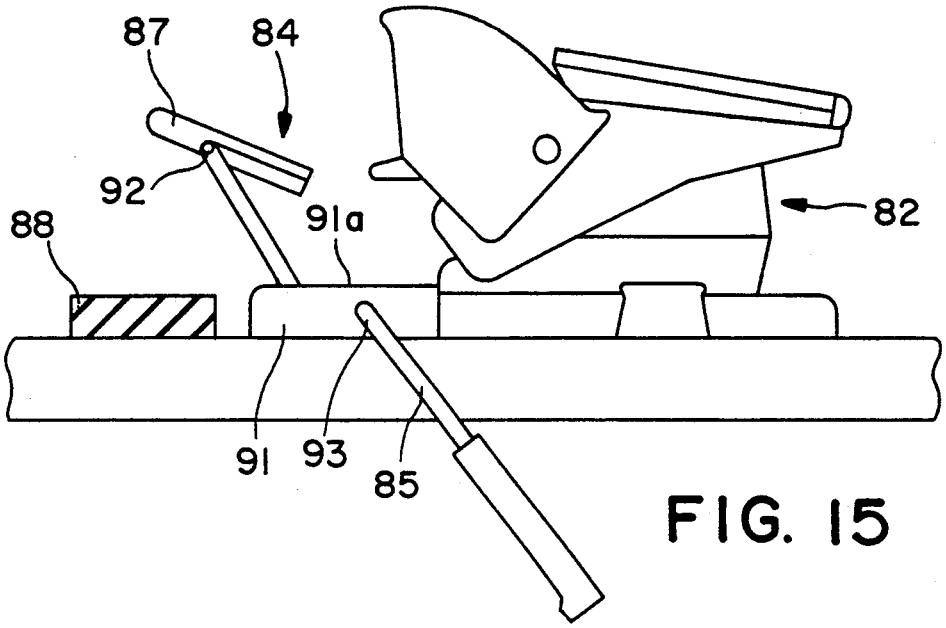
FIG. 15 is a raised view of a variant of a ski brake according to the invention, in braking position.
Figure 16:
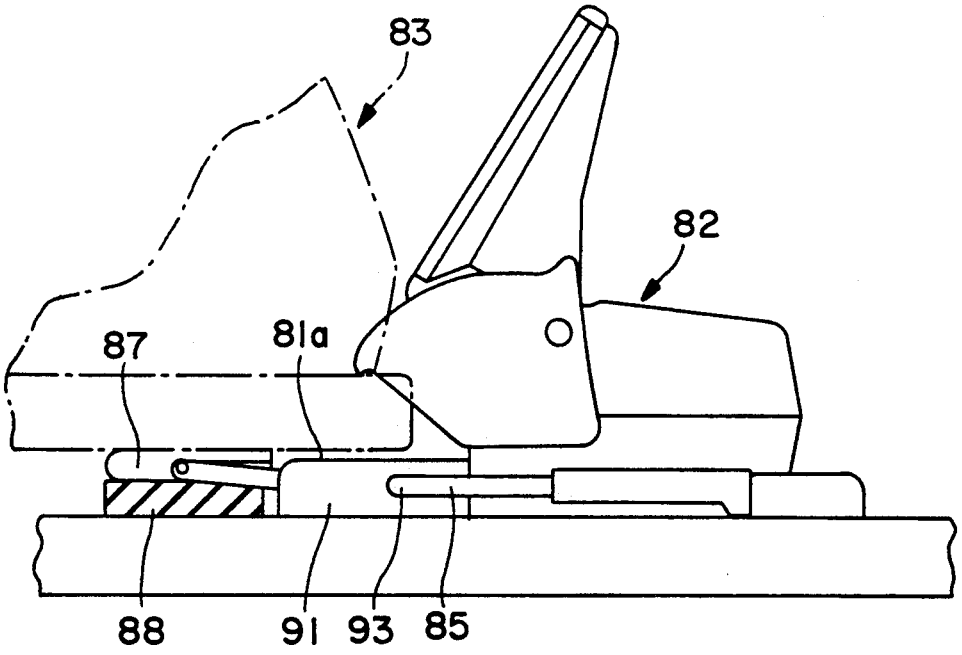
FIG. 16 is a raised view of the ski brake in FIG. 8 in inactive position.

In the variant shown in FIGS. 15 and 16, the ski brake 84 comprises a base 91 on which the stop arms 85 are jointed around a transverse axis 93. The control pedal of the brake 87 is jointed to the upper part of the arms around a transverse hinge pin 92.

The control pedal is thus mobile in the vertical, longitudinal plane of the ski, in particular because it rotates around the transverse axis 93. On the other hand, this articulation prevents all other motion of the pedal, except for movement around the other axis 92.

Brake energy is generated by elastic torsion of the wire constituting the arms of the brake 85, at the base 91. As in the embodiment described with reference to FIG. 11, the shock-absorption block 88 is attached to the ski in the area in which the pedal 87 is depressed, when the brake is in inactive position. The shock-absorption block 88 can also be placed beneath the pedal 87, as shown in FIGS. 8 to 10. The upper part of the base 91 incorporates a support surface 91*a* located at a distance from the upper surface of the ski which is a little smaller than the sum of the thicknesses of the pedal 87 and of the shock-absorption block 88 positioned beneath this pedal, so that this upper surface 91*a* forms a stop for the heel of the boot when the shock-absorption element 88 is very vigorously stressed and strongly crushed. Otherwise, during normal progress, the shock-absorption block 88 holds the upper surface of the pedal 87, then in horizontal position (as shown in FIG. 9), substantially above the upper support surface 91*a* of the base 91. It is then that the boot 83 is supported on the upper surface of the pedal 87. The heel of the boot 83 can thus swivel with the pedal 87 in a vertical plane above the level of the support surface 91*a* of the base. This swivelling motion in a vertical plane is limited downward by the upper support surface 91*a* of the base 91.

As in the preceding cases, the support plate of the boot, which is here constituted by the brake pedal, accompanies and damps, by means of the layer 88, the vertical movements of the boot in relation to the ski. On the other hand, the axes 92 and 93 prevent other movements, in particular lateral movements, of the boot in relation to the ski during turns and when the edges are dug in the snow.

Furthermore, the jaw belonging to the binding follows the vertical movements of the boot and keeps the boot pressed against the pedal 87.

These movements determine the high level of precision with which the ski is steered.

The layer of elastically-compressible material may be made interchangeable, so as to vary its hardness. Each hardness can be color-coded. Thus, depending on the nature of the snow, the skier can choose the most suitable material.

In addition, the invention is applicable to other brake designs, in particular those in which the control pedal forms the upper side of a deformable, trapezoidal configuration.

We claim:

1. Alpine ski binding designed to hold the rear end of a ski boot and comprising a body (3, 43, 53, 74) connected to the ski, a jaw device (2) for position retention of the rear end of the boot carried by the body, and a support plate (9, 39, 49, 69) for the boot, on which the rear end of the sole presses in the normal position in which the boot is held in place in the binding, wherein said support plate (9, 39, 49, 60) is movable exclusively in the median longitudinal and vertical plane of the ski and jointed for rotation around a horizontal, transverse axis (25, 45, 55, 72), and a layer (15, 46, 56, 76, 88, 89, 90) of an elastically-compressible material is interposed between said support plate (9, 39, 49, 69, 87) and the upper surface of the ski, said body (43) being mounted so as to slide along a slide-rail (44) attached to the ski, said support plate (39) being extended rearward by two lateral arms (47, 48) extending along each of lateral edges of said slide-rail (44), and the hinge pin (45) of said support plate (39) is given physical form by two half axes which join together each of said lateral arms (47, 48) to one lateral edge of said slide-rail (9).

2. Binding according to claim 1, wherein said support plate (69) of said boot is constituted by two elements (70, 71) arranged on either side of the median longitudinal and vertical axis of the ski, each of said elements is jointed around a common horizontal, transverse axis (72), and a block (75) of an elastically-compressible material is interposed between the free end of each of said elements (70, 71) and the upper surface of the ski.

3. Binding according to claim 2, wherein said two elements (70, 71) are connected by movable coupling means (77).

4. Binding according to claim 1, further comprising a ski brake constituted by at least one brake arm (12) which is movable in rotation around a transverse axis (11) and a control pedal (13) actuating said brake arm (12), wherein said support plate (9) further forms the base of said ski brake and carries the hinge pin (11) of said brake arm or arms.

5. Binding according to claim 1, to which is associated a ski brake whose control pedal constitutes the support plate on which the sole of the boot rests, wherein said layer of elastically-compressible material (88, 89, 90) is interposed between said control pedal (87) of said brake and said upper surface (81*a*) of the ski (81).

6. Binding according to claim 5, wherein said layer of elastically-compressible material (8, 9, 10) is solidly connected to said upper surface of the ski.

7. Binding according to claim 5, wherein said layer of elastically-compressible material (8, 9, 10) is solidly attached to the lower face of said brake control pedal (87).

8. Binding according to claim 1, wherein the material used in the layer of elastically-compressible material (15, 46, 56, 76, 88, 89, 90) has a hardness of between 10 and 90 Shore A.

9. Alpine ski binding designed to hold the rear end of a ski boot and comprising a body (3, 43, 53, 74) connected to the ski, a jaw device (2) for position retention of the rear end of the boot carried by the body, and a support plate (9, 39, 49, 69) for the boot, on which the rear end of the sole presses in the normal position in which the boot is held in place in the binding, wherein said support plate (9, 39, 49, 69) is movable exclusively in the median longitudinal and vertical plane of the ski, and jointed for rotation around a horizontal transverse axis (25, 45, 55, 72), and a layer (15, 46, 56, 76, 88, 89, 90) of an elastically-compressible material is interposed between said support plate (9, 39, 49, 69, 87) and the upper surface of the ski, wherein said body (3) is mounted so as to slide along a slide-rail (4) of the ski, a rear part of said slide-rail (4) being held in place by a stirrup piece (9) of said ski, said support plate (9) being extended rearward by two lateral arms (17, 18) extending along each lateral edge of said slide-rail (9), and a hinge pin (25) of said support plate (9) is given physical form by two half axes which join together each of said arms (17, 18) to a lateral edge of said stirrup piece (19).

10. Alpine ski binding designed to hold the rear end of a ski boot and comprising a body (3, 43, 53, 74) connected to the ski, a jaw device (2) for position retention of the rear end of the boot carried by the body, and a support plate (9, 39, 49, 69) for the boot, on which the rear end of the sole presses in the normal position in which the boot is held in place in the binding wherein said support plate (9, 39, 49, 69) is movable exclusively in the median longitudinal and vertical plane of the ski, and jointed for rotation around a horizontal transverse axis (25, 45, 55, 72), and a layer (15, 46, 56, 76, 88, 89, 90) of an elastically-compressible material is interposed between said support plate (9, 39, 49, 69, 87) and the upper surface of the ski, wherein said body is mounted so as to slide along a slide-rail attached to the ski, and a hinge pin of said support plate is carried by said binding body.

11. Alpine ski binding designed to hold the rear end of a ski boot and comprising a body (3, 43, 53, 74) connected to the ski, a jaw device (2) for position retention of the rear end of the boot carried by the body, and a support plate (9, 39, 49, 69) for the boot, on which the rear end of the sole presses in the normal position in which the boot is held in place in the binding, wherein said support plate (9, 39, 49, 69) is movable exclusively in the median longitudinal and vertical plane of the ski, and jointed for rotation around a horizontal transverse axis (25, 45, 55, 72), and a layer (15, 46, 56, 76, 88, 89, 90) of an elastically-compressible material is interposed between said support plate (9, 39, 49, 69, 87) and the upper surface of the ski, wherein said body is mounted so as to slide along a slide rail attached to the ski, wherein said support plate is extended rearward by two lateral arms extending along each of lateral edges of said slide-rail, and a hinge pin of said support plate is connected to an element of said binding.

* * * * *